US010246253B2

(12) United States Patent
Chynoweth et al.

(10) Patent No.: US 10,246,253 B2
(45) Date of Patent: Apr. 2, 2019

(54) FLOATING ROOF REEL TYPE GROUND

(71) Applicant: Lightning Eliminators, Boulder, CO (US)

(72) Inventors: Kirk S. Chynoweth, Louisville, CO (US); Lee B. Howard, Arvada, CO (US)

( * ) Notice: Subject to any disclaimer, the term of this patent is extended or adjusted under 35 U.S.C. 154(b) by 738 days.

(21) Appl. No.: 15/006,487

(22) Filed: Jan. 26, 2016

(65) Prior Publication Data

US 2016/0244255 A1 Aug. 25, 2016

Related U.S. Application Data

(60) Provisional application No. 62/120,495, filed on Feb. 25, 2015.

(51) Int. Cl.
*B65D 88/46* (2006.01)
*B65D 90/46* (2006.01)

(52) U.S. Cl.
CPC ..... *B65D 90/46* (2013.01); *B65D 88/46* (2013.01)

(58) Field of Classification Search
CPC ..... B65D 90/46; B65D 88/46; H01H 9/12; H01R 13/6596
USPC ..... 242/615.3, 599.3, 615
See application file for complete search history.

(56) References Cited

U.S. PATENT DOCUMENTS 3,311,698 A * 3/1967 Cockroft ..... H01R 4/00 174/43
3,453,493 A * 7/1969 Godwin, Jr. ..... H05F 3/02 174/6
3,887,254 A * 6/1975 Landis ..... H01R 4/64 439/35
3,942,674 A * 3/1976 Nelson ..... B65D 90/46 220/221
4,940,859 A * 7/1990 Peterson ..... H01R 13/72 191/12.2 R
5,159,523 A * 10/1992 Claassen ..... B67D 7/3236 340/649
5,711,143 A * 1/1998 Munakata ..... H01B 5/104 57/215
6,127,934 A * 10/2000 Powell, Jr. ..... F16L 11/12 340/649
6,626,391 B2 * 9/2003 Kretsch ..... A01K 3/00 242/395.1
7,078,621 B1 * 7/2006 Carpenter, Jr. ..... H02G 11/02 174/40 CC
7,413,171 B2 * 8/2008 Reznar ..... B62D 43/045 242/615.3
2010/0206976 A1 * 8/2010 Salentine ..... A45F 5/004 242/379.2

* cited by examiner

*Primary Examiner* — Michael R Mansen
*Assistant Examiner* — Mark K Buse
(74) *Attorney, Agent, or Firm* — Patent Law Offices of Rick Martin, P.C

(57) ABSTRACT

In a fluid reservoir tank such as an oil tank, the metal roof floats. The American Petroleum Institute (API) Recommended Practice (RP) number 545 requires a floating roof to tank resistance of less than 30 milli-ohms. The improved cable system uses a preferred aluminum braided cable to provide low resistance combined with resistance to sour fluids. Prior art used copper and tinned copper braided cables. The new reel is factory pre-assembled and tensioned using a new cable guide with a cable stop bar which stops a cable stop attached near the end of the (approximately 80 foot) cable. A new spring assembly increased tension and extends cable life by minimizing slack in the cable.

20 Claims, 10 Drawing Sheets

FLOATING ROOF REEL TYPE GROUND

CROSS REFERENCE TO RELATED APPLICATION

This application claims priority to U.S. Prov. App. No. 62/120,495 filed Feb. 25, 2015.

FIELD OF INVENTION

The present invention relates to improvements over U.S. Pat. No. 7,078,621 (2006) to Carpenter, Jr. et al. Years of field experience resulted in engineering an improved cable and reel assembly.

BACKGROUND OF THE INVENTION

The roof of many large crude storage tanks is open in the sense that there is no permanently attached roof. The roof floats on top of the product. To prevent vapors from escaping from around the edge of the roof, it is common to provide some sort of seal. These seals are made of a non-conductive material, usually neoprene. This material isolates the roof from the tank wall electrically and from any connection to earth. To overcome this problem, the industry has installed a device called a "shunt." These shunts are attached to the roof in such a manner that they are to be in constant contact with the tank regardless of the position of the floating roof. To make contact, these shunts are made with metal fingers which are spring-loaded and are made springy by the material used. These shunts require constant maintenance for several reasons:

1. Since the roof floats, it can easily drift slightly off-center and disconnect from the shunt on the opposite side.
2. Wax and other heavy crude elements tend to deposit between the tank wall and the shunt fingers, leaving a small gap which can cause arcing and fire.

Such a fire is called a "rim fire". In this case, the arc ignites the gasses always prevalent around the rim just above the seal.

During an electrical storm, the electrostatic field will induce a charge on both the tank and the floating roof. The present invention (RGA) will equalize the electrical potential between the tank shell (wall) and floating roof at all times, but especially in the case of a direct lightning strike to either the floating roof itself or tank shell. Charge from the direct (or nearby) strike will simultaneously flow in all directions across the shell and roof, eventually reaching ground via the shell. As charge on the roof attempts to reach ground, arcing will be produced at the shunts. If the shunts are not in perfect contact with the tank wall, the charge will create an arc when that storm cell is discharged by a direct or nearby strike. In accordance with testing performed by Cullham on behalf of the API 545 committee, the fast component of the lightning strike waveform is too short to ignite vapors. Rather, it is the rather longer follow-on current that may produce arcing and sparking which can ignite the vapors.

Eliminating the risk of arcing requires making a full-time positive connection between the tank wall and roof of the tank, as well as having a low resistance path of about 30 milli-ohm or less. Making a positive connection will eliminate this risk and any other phenomena that can create dangerous arcing conditions. The present invention discloses a grounding system that improves the prior art by resisting corrosion using an aluminum cable instead of a tinned copper cable and reduce resistance with an improved reel assembly.

SUMMARY OF THE INVENTION

The main aspect of the present invention is to provide an aluminum cable to a reel type roof grounding system so that the API standard of under 30 milli-ohms resistance is met per API Recommended Practices RP 545.

Another aspect of the present invention is to use a flat weaved cable having 1056 wires at 30 gauge each, 1⅜" wide and 0.120" thick.

Another aspect of the present invention is to provide a dual cable aluminum connection assembly to the roof to reduce cable wear.

Another aspect of the present invention is to provide a pre-tensioned reel assembly having a cable stop and a reel housing cable stop anchor, thereby simplifying cable installation.

Another aspect of the present invention is to provide a very strong dual spring tension assembly to increase cable retraction force over three times with a cable payout maximum of about 80 pounds to about 90 pounds pull, thereby reducing cable movement and increasing life expectancy.

Another aspect of the present invention is to reduce axle to housing electric resistance by installing a bracket from the axle to the housing.

Another aspect of the present invention is to provide an improved cable guide with a built in cable stop anchor and a connection to the axle.

Other aspects of this invention will appear from the following description and appended claims, reference being made to the accompanying drawings forming a part of this specification wherein like reference characters designate corresponding parts in the several views.

A reel is mounted at the top of the inside of a fluid/liquid storage tank. The grounding cable unreels from the reel as the floating roof is lowered down into the tank as the stored fluid/liquid level lowers. As the floating roof rises a take up assembly in the reel takes up the slack, preferably by maintaining a constant pressure on the grounding cable. Electric charge on the floating roof is conducted through the grounding cable, and the reel, to the tank wall and thence to the earth ground.

The reel assembly guide is constructed from 316 stainless steel, with provisions for mounting on the top edge of the tank: one model for edge mounting, and the other for mounting on the top angle. The flat aluminum conductor end is attached to a roof structure, using several possible options. Since floating roof tanks can be struck by lightning in any location on or around the tank, charge should be removed as quickly as possible and as closely as possible to the strike location. To assure that path is not too long, more than one grounding system may be required. To provide an estimate of the number of these grounding systems, the following criteria is suggested;

Tank Diameter (Meters) Versus # of Grounding Systems Recommended:

| | |
|---|---|
| Up to 20 Meters | 2 (minimum) |
| Up to 30 Meters | 4 |
| Up to 50 Meters | 6 |
| Up to 60 Meters | 7 |
| Up to 70 Meters | 8 |
| Up to 80 Meters | 9 |

-continued

| | |
|---|---|
| Up to 90 Meters | 10 |
| Up to 100 Meters | 11 |

The new aluminum cable replaces an anti-corrosion tin plated copper cable, thus extending the life of the cable at no cost increase. The pre-tensioned reel assembly reduces hours of install time. The axle to housing brace ensures a positive electric connection even with extensive dirt and grime build up.

As revealed by the comparative corrosion testing, the aluminum cable samples significantly outperform both bare and tinned copper cables when exposed to a severe $H_2S$ environment. The aluminum is highly resistant to this sour gas environment and, unlike copper, is not subject to embrittlement. It may therefore be expected that the aluminum cable offers a significant improvement in operational lifespan over bare and tinned copper cables in an FRT environment.

5154A aluminum was originally developed by Alcoa for use in marine environment applications requiring high strength and a high level of corrosion resistance. Strength testing of the 1,056/30 braided aluminum cable yielded an ultimate strength of 2,180 lb. [9.7 kN], or about 25% higher than an 864/30 braided copper cable which failed at 1,750 lb. [7.8 kN]. In addition, the modulus of elasticity or resistance to elastic (non-permanent) deformation, of the aluminum is less than the stiffer copper (70.5 GPa vs. 117 GPa).

In addition to cable material improvements, the strength of the internal springs have been increased in order to improve the amount of cable tension between the stainless steel reel (mounted at the tank lip) and free end of the cable (secured to the floating roof). Over the entire payout range of the new aluminum cable system (RGA 750) (80ft. [24.4 m]), cable retraction force has been increased 340% over the prior art RGA 75 and 600% over the prior art RGA 55 on average, with tension increasing significantly toward the limits of cable payout to a maximum of approximately 87 lb. [39.5 kg]. Greater tension in the RGA cable will result in a reduced amount of cable movement and a corresponding increase in life expectancy.

5154A braided aluminum cable outperforms copper and tinned copper in a sour gas environment, while meeting the requirements of API RP 545 (Recommended Practice for Lighting Protection of Aboveground Storage Tanks for Flammable or Combustible Liquids). Further, unlike copper and tin, aluminum is not subject to sulfide stress cracking. Finally, with improvements in available spring retraction force of 340-600% over previous models, a great reduction should be seen in cable flexion and twisting due to wind currents within the confines of the tank shell. Therefore, the new aluminum cable (RGA 750) will outperform previous models and offer substantial upgrades in the operational lifespan of the cable.

BRIEF DESCRIPTION

FIG. 1 is a vertical sectional view of the tank with the new invention installed.

FIG. 2 is an isometric perspective view of the new reel assembly.

FIG. 3 is an isometric perspective view of the new reel assembly with the cable stop engaged with the cable stop anchor.

FIG. 4*a* is a side elevation view of the cable stop.

FIG. 4*b* is a front elevation view of the cable stop.

FIG. 4*c* is an isometric perspective view of the cable stop.

FIG. 5*a* is a top plan view of the aluminum cable.

FIG. 5*b* is a side elevation view of the aluminum cable.

FIG. 6 is an isometric perspective view of the all aluminum double braid cable anchor.

FIG. 7 is a inside the tank front elevation view of an installed cable grounding system.

FIG. 8 is an exploded view of the reel assembly.

FIG. 9 is a side elevation view of one of the two springs in the reel.

FIG. 10 (prior art) is a side elevation view of a reel with the axle shown resting in the cradle of the mounting bracket.

FIG. 11 is a right side elevation view of a reel and mounting bracket.

FIG. 12 is a top perspective view of the unassembled double braid connector.

Other aspects of this invention will appear from the following description and appended claims, reference being made to the accompanying drawings forming a part of this specification wherein like reference characters designate corresponding parts in the several views.

BRIEF DESCRIPTION OF THE DRAWINGS

Referring first to FIG. 1 the cable grounding system 100 grounds the floating roof 23 to the tank wall 21 of a fluid tank. As the floating roof 23 moves up and down on fluid 22 it is centered in the cylindrical wall 21 by a known scissor assembly 33. A known fumes barrier 34 rides along the inside of the cylindrical wall 21 as does the scissor assembly 33. A known grounding shunt 35 also rides along the inside of cylindrical wall 21. However, this grounding shunt 35 is prone to lose its grounding connection to cylindrical wall 21 for many reasons including an out of round cylindrical wall, and/or rust and debris build up on the inside of the cylindrical wall 21. A vertical flange 23F on the floating roof 23 provides a contact for connecting the cable 101 to a double braid cable anchor 102 which connects the cable 101 to the vertical flange 23F. A cable stop 103 is usually bolted about a foot up from the cable anchor 102. The cable grounding system 100 meets the American Petroleum Institute Recommended Practice 545 for under 30 milli-ohms resistance from the roof 23 to the tank wall 21.

The reel 106 has cable guide 104 which has an integral cable stop anchor 105. The reel 106 is shown bolted to a known right angle bracket 107 which is fastened to an upper ledge 108 of the cylindrical wall 21. Alternately the direct wall bracket 110 can be wall mounted. The reel's U shaped mounting bracket 110 is bolted to bracket 107.

Figure 1:
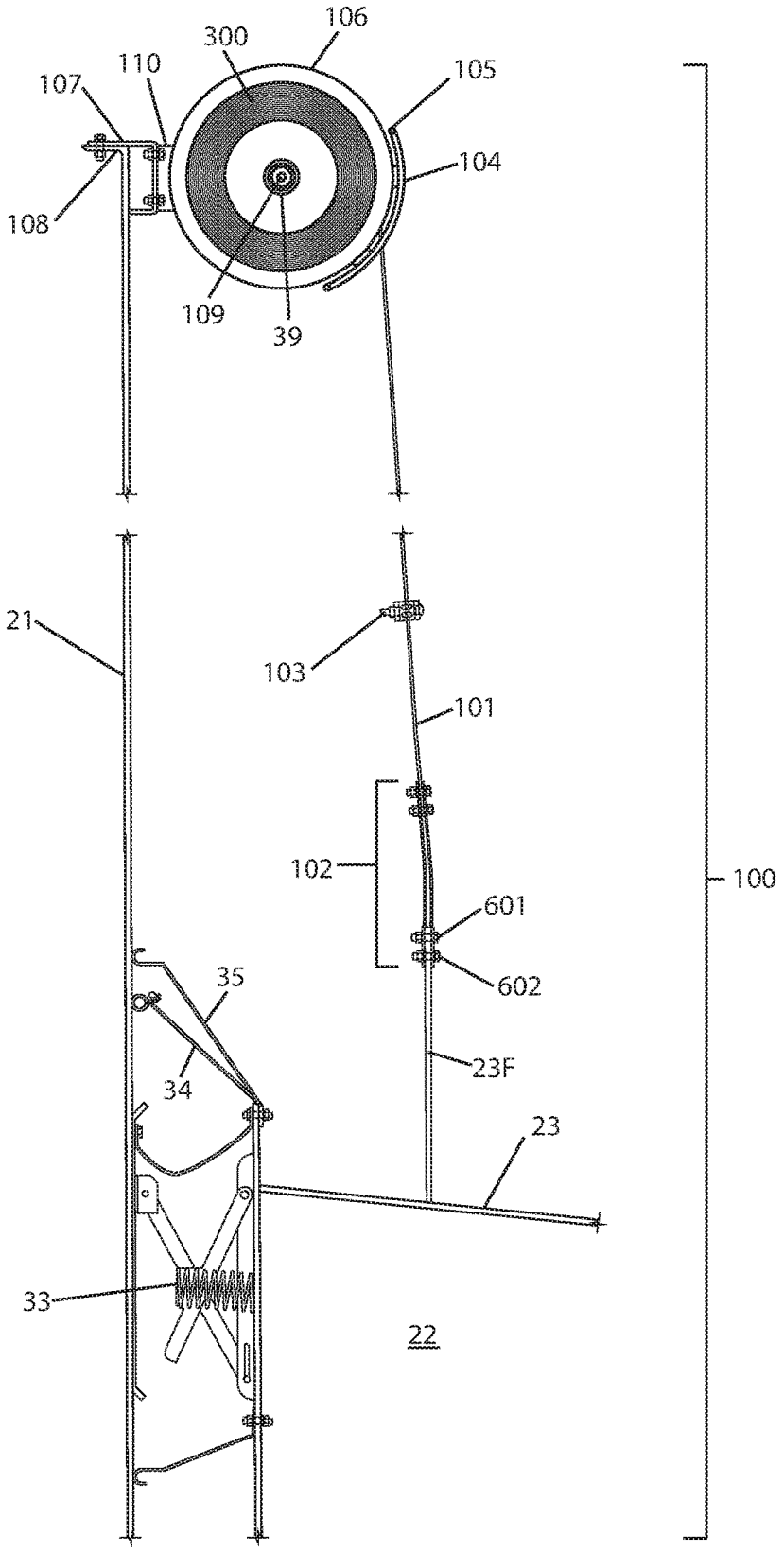

A spring assembly 109 keeps any slack out of cable 101 and forms adjacent cable windings 300.

The cable 101 is preferably aluminum to meet the low resistance specification from API (under 30 milli-ohms) from the floating roof 23 to the tank wall 21. It was found that using a tin coated copper cable in a sour gas environment, the cable corroded and failed prematurely. Silver or gold cables could be used, but the cost makes it not feasible. Also the risk of theft would be enormous.

Figure 2:
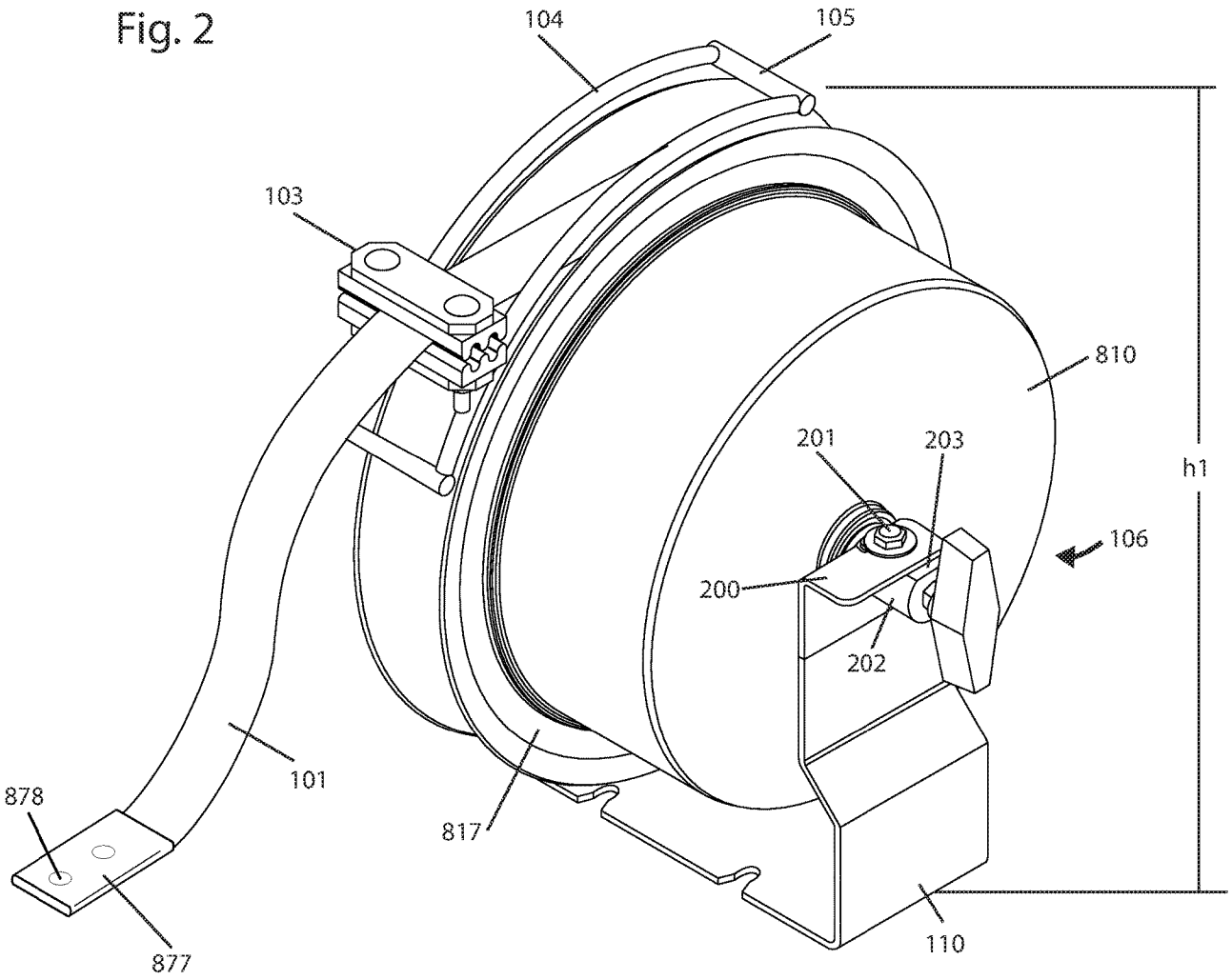
Figure 10:
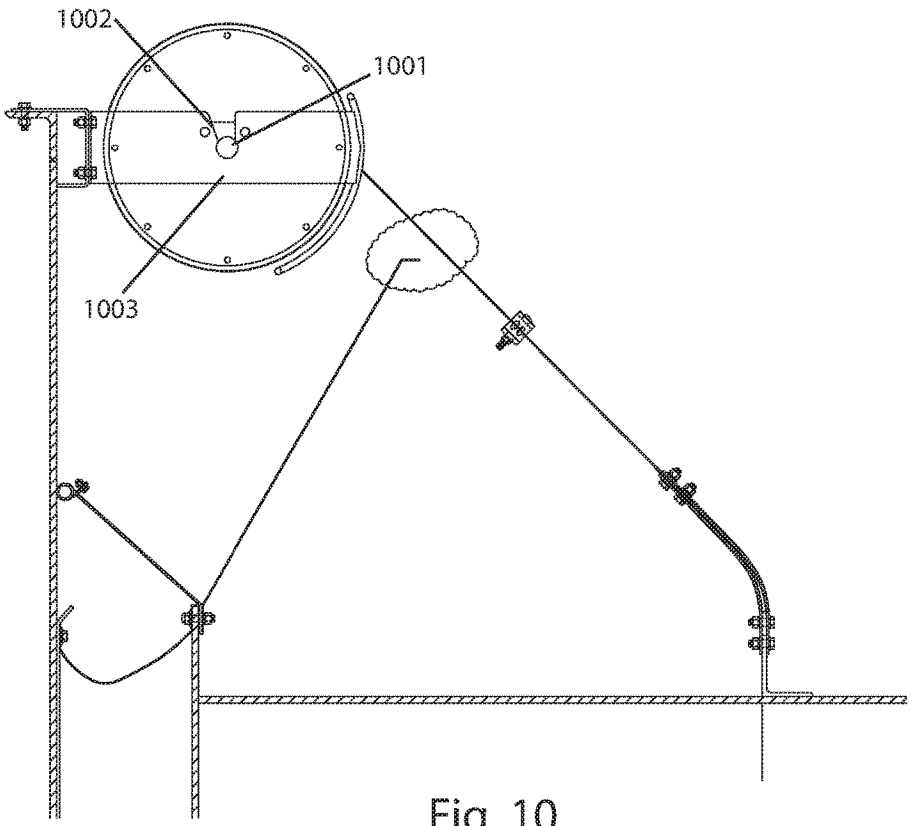
Fig. 10 (PRIOR ART)
Figure 11:
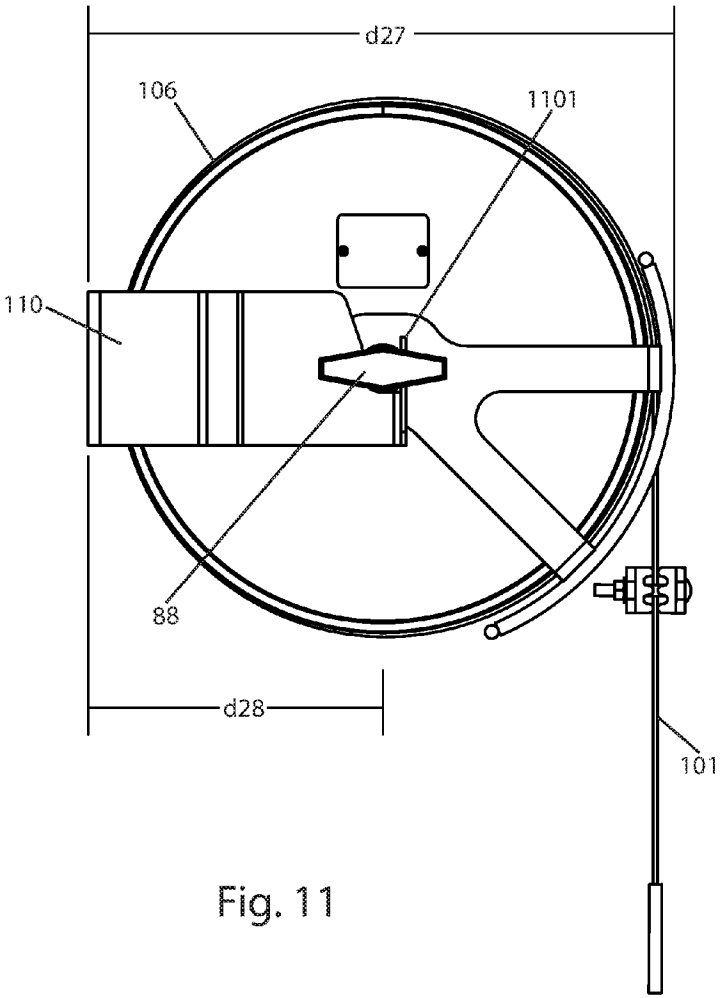

Referring next to FIG. 2 the reel 106 is supported by a new and non-obvious U shaped mounting bracket 110. At each end of the bracket an axle mounting flange 200 has a bolt 201 that screws into the axle 202. This connection provides a large electrical contact area for a lightning discharge (or any discharge) to pass from the reel 106 to a flat indent 203 on the axle 202 to the axle mounting flange 200, then to the U shaped mounting bracket 110 then to the bracket 107 and then to the tank wall 21. The reel 106 is gravity mounted in cradles 1101 as seen best in FIG. 11. The bolts 201 complete the securing of the reel 106 to the bracket 110. In FIG. 10 (prior art) the axle 1001 rested on cradle 1002. The only electric path was from the sheet metal width of the bracket 1003 to the axle 1001. Dirt and grime buildup could increase the resistance across that joint to an unsatisfactory level.

The reel housing 810 spins with the rotation of the reel 106. The spool assembly 817 supports the cable 101. The cable 101 has a distal connector 877 which sandwiches the cable 101 in an aluminum sheath, and then holes 878 are drilled. The cable guide 104 has a guide mount 879 that is welded "WELD" to the axle 202. The axle 202 does not rotate. The handle 88 is threaded into the end of the axle 202 so as to provide an aid for lifting the heavy reel 106 during installation. The cable is preferably 1⅜" wide by 0.120" thick. The reel 106 is sized to lift 70 to 80 feet of cable 101. The reel weight is about 78 pounds. The cable tension at 70 foot payout is about 66 pounds. Height h1 is about 16.21 inches.

Figure 3:
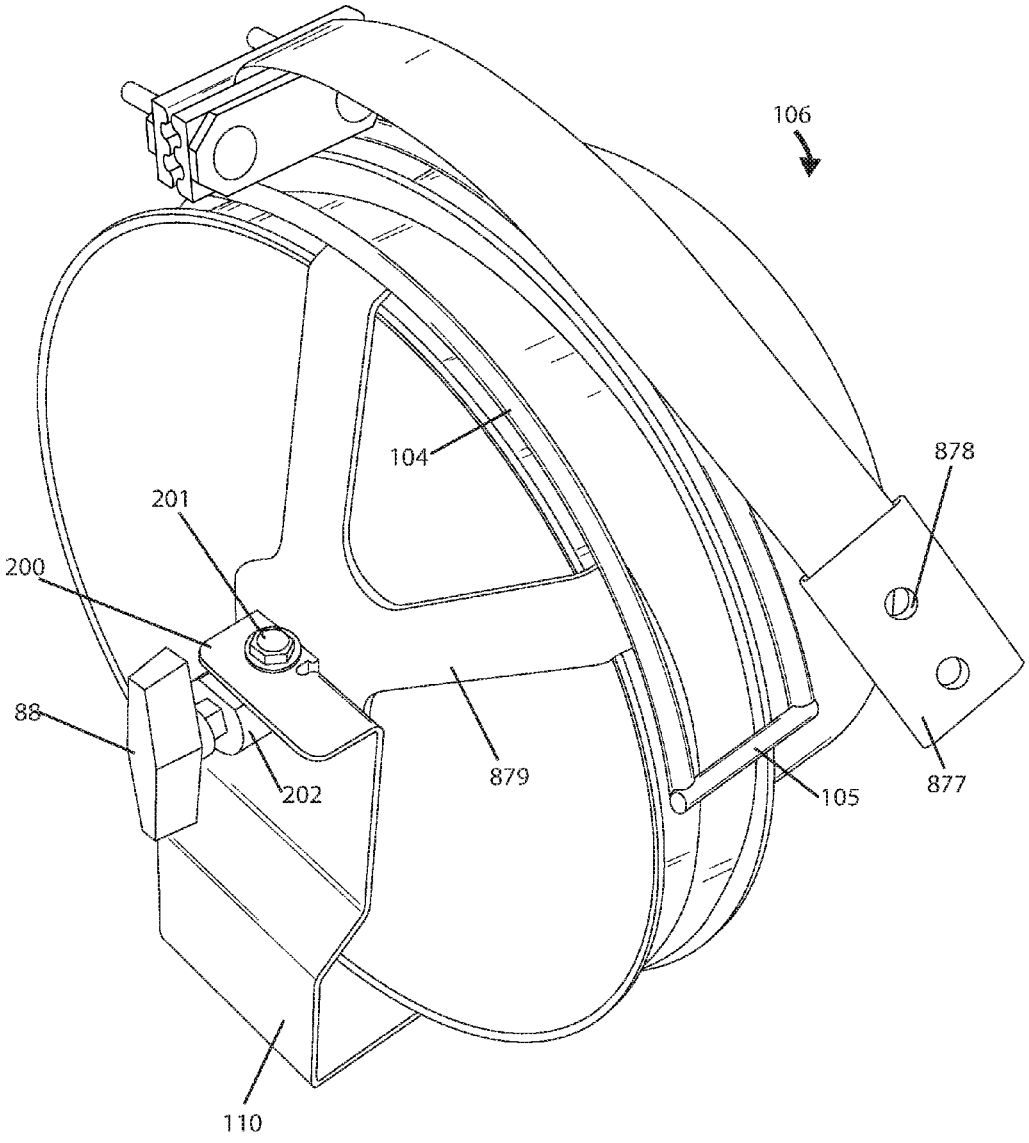

Referring next to FIG. 3 the reel 106 is shown ready to be installed inside a tank. The reel is pre-tensioned at the factory with the cable stop 103 tensioned against the cable stop bar 105. The handles 88 help the installer carry the reel 106 up a ladder or around the worksite. The bolts 201 secure the reel 106 to the bracket 110 at any angle.

Figure 4C:
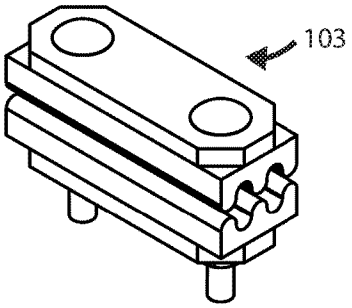
Figure 4B:
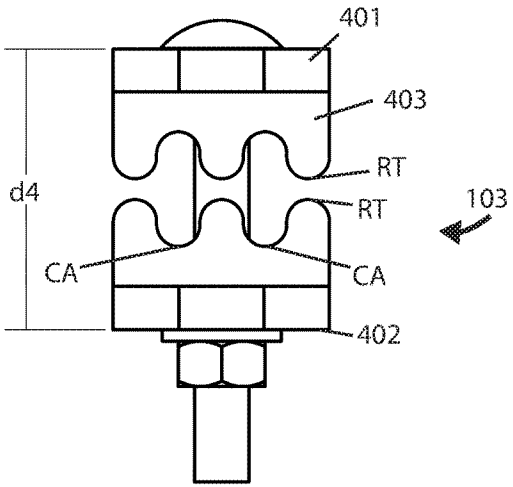
Figure 4A:
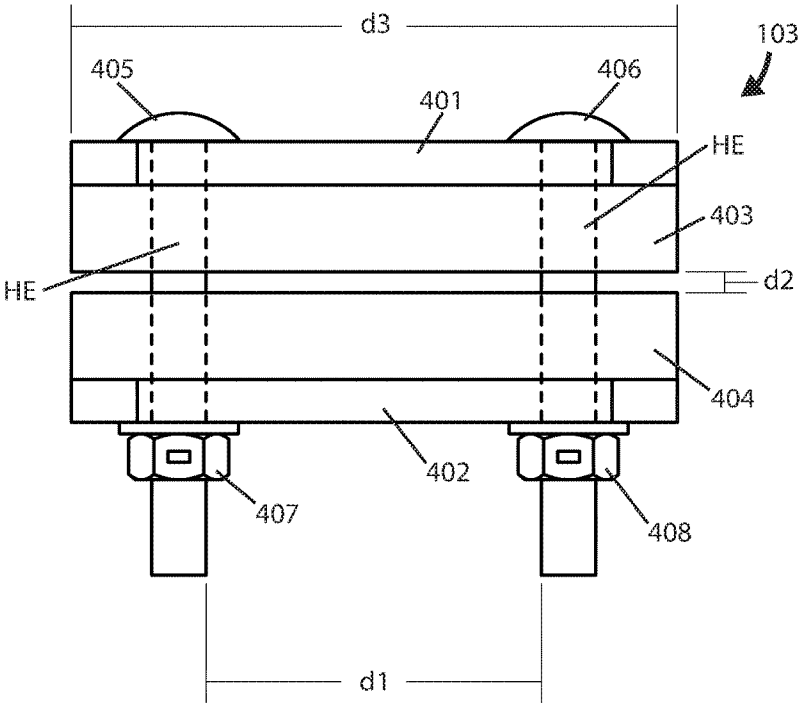

Referring next to FIGS. 4*a*, 4*b*, 4*c* the cable stop 103 has two parallel preferably SS plates 401, 402. Holes HE pass through the plates 401, 402 and the rubber jaws 403, 404. Bolts 405, 406 with nuts 407, 408 lock the jaws 403, 404 against the cable 101. Groves CA in each jaw 403, 404 help maximize the clamping pressure at ridges RT.

Figure 5A:
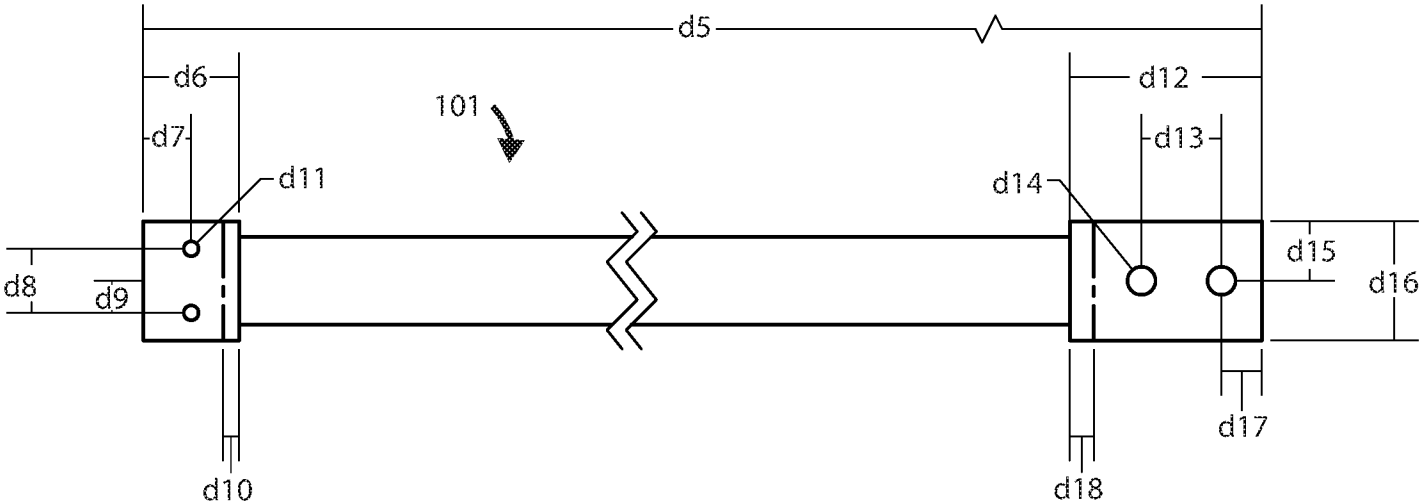
Figure 5B:
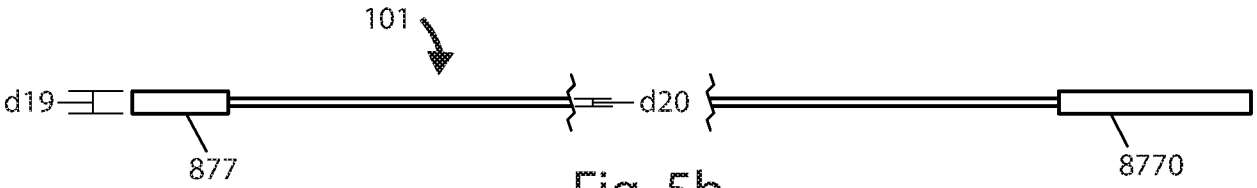

Referring next to FIGS. 5*a*, 5*b* details of the cable 101 are shown. First the end of the cable braid is doubled over. Then the clamp 877 is applied around the doubled over (aluminum) braided cable. Then the clamp 877 is crimped to a thickness of about 0.35". No cable should extend beyond the end of the clamp 877. The holes 878 are preferably about 0.23 inch in diameter. The reel anchor end has a clamp 8770 with holes 8780 about 0.44 inch in diameter.

Figure 6:
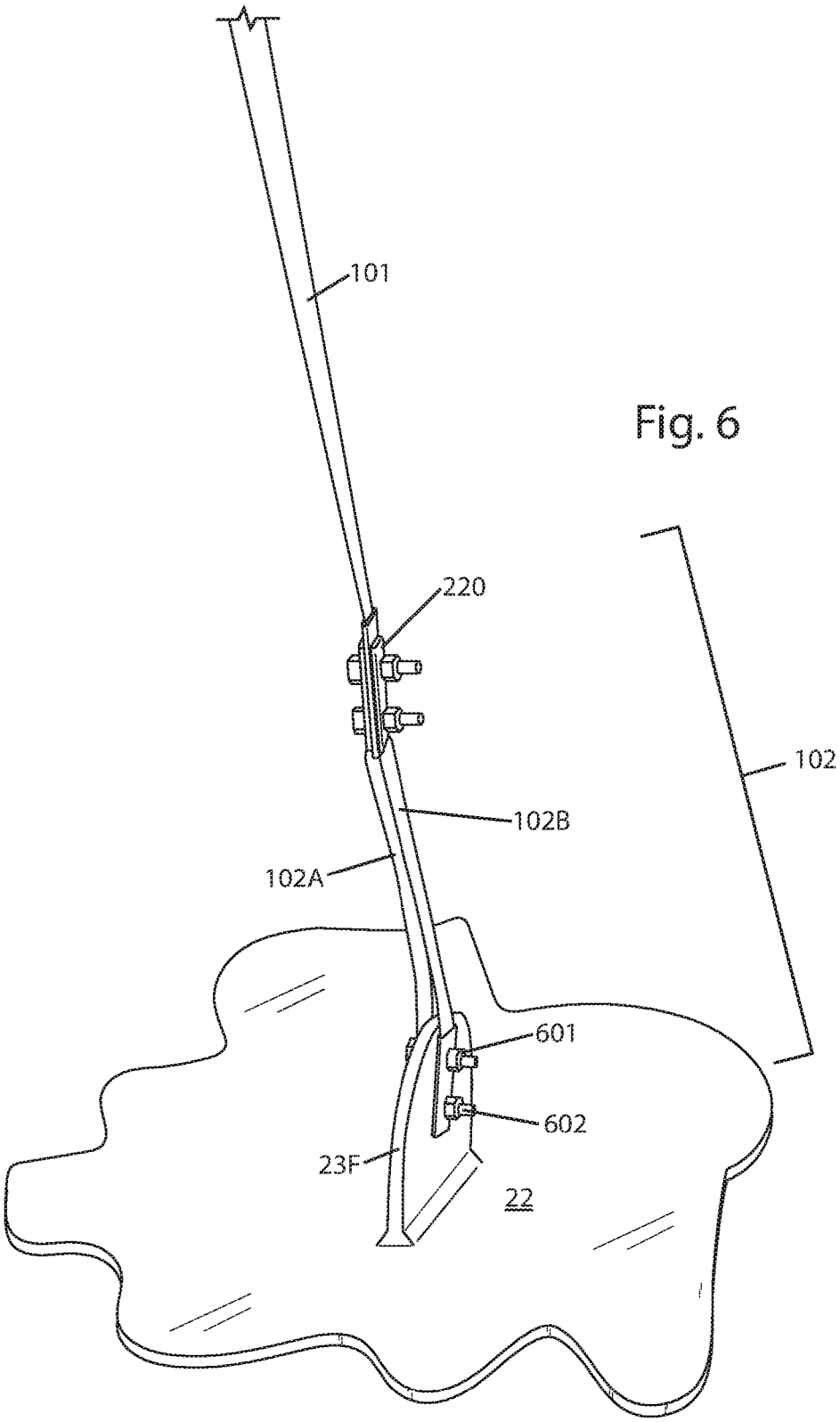
Figure 12:
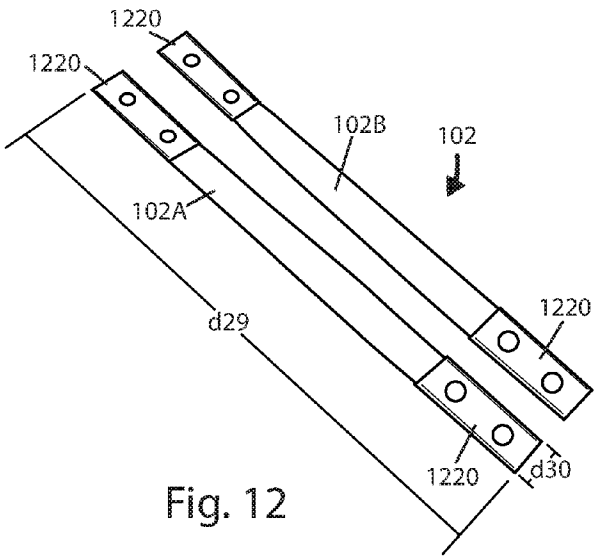

Referring next To FIGS. 6 and 12 the double braided connector assembly 102 is shown. It has two bolts 601, 602 fastening it to flange 23F of floating roof 22. Braided cables 102A and 102B are identical. Each is one inch wide. The preferably aluminum clamps 1220 are all identical. A duplicate set of bolts 601, 602 fasten the end clamp 877 to the double braid clamps 1220. Each braid 102A, 102B is about 0.14 inch thick, and the weave is 768 wires at 30 gauge each (768/30). Again preferably the braid is doubled over before the clamp 1220 is crimped on. This preferably aluminum double braid connector saves wear and tear on the moving cable 101.

Figure 7:
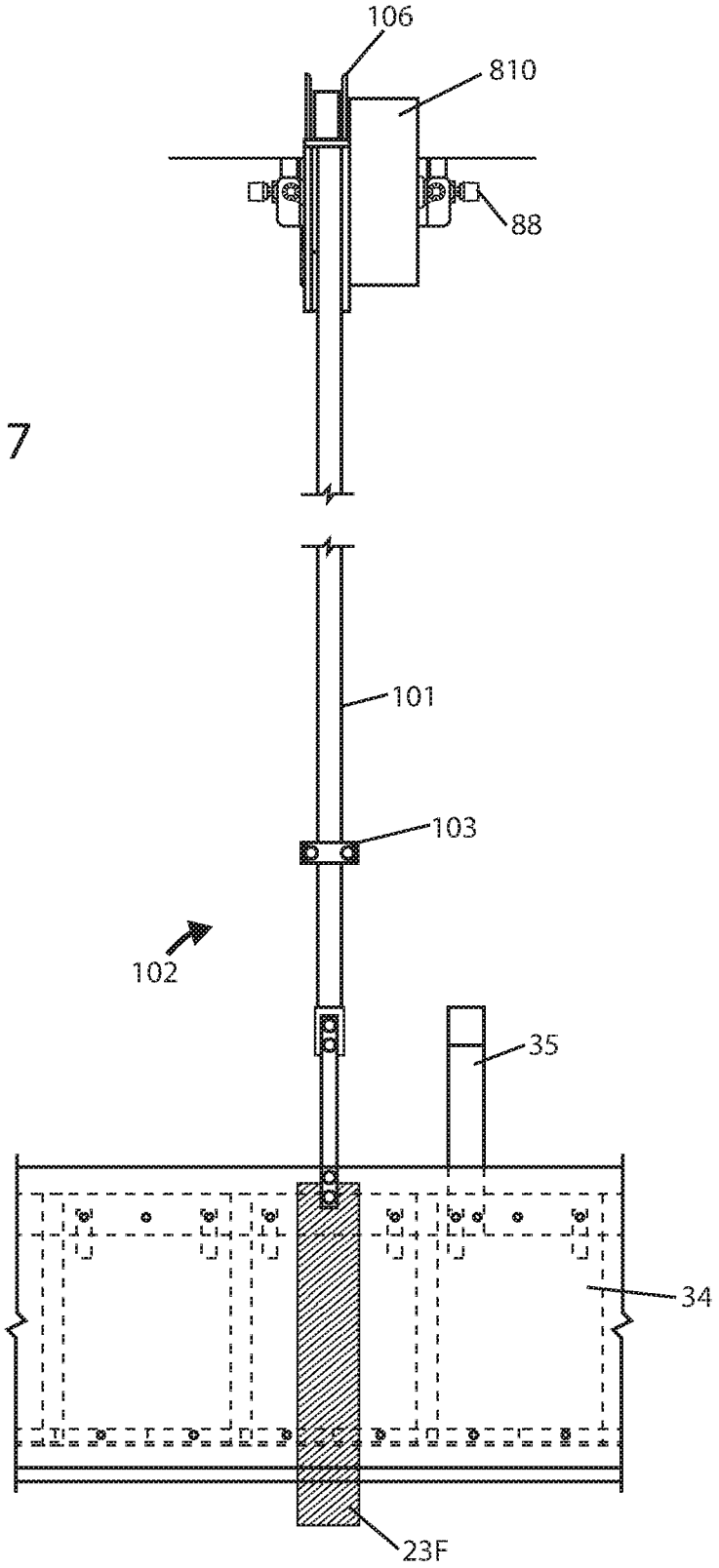

Referring next to FIG. 7 a front elevation view of the apparatus of FIG. 1 is shown.

Figure 8:
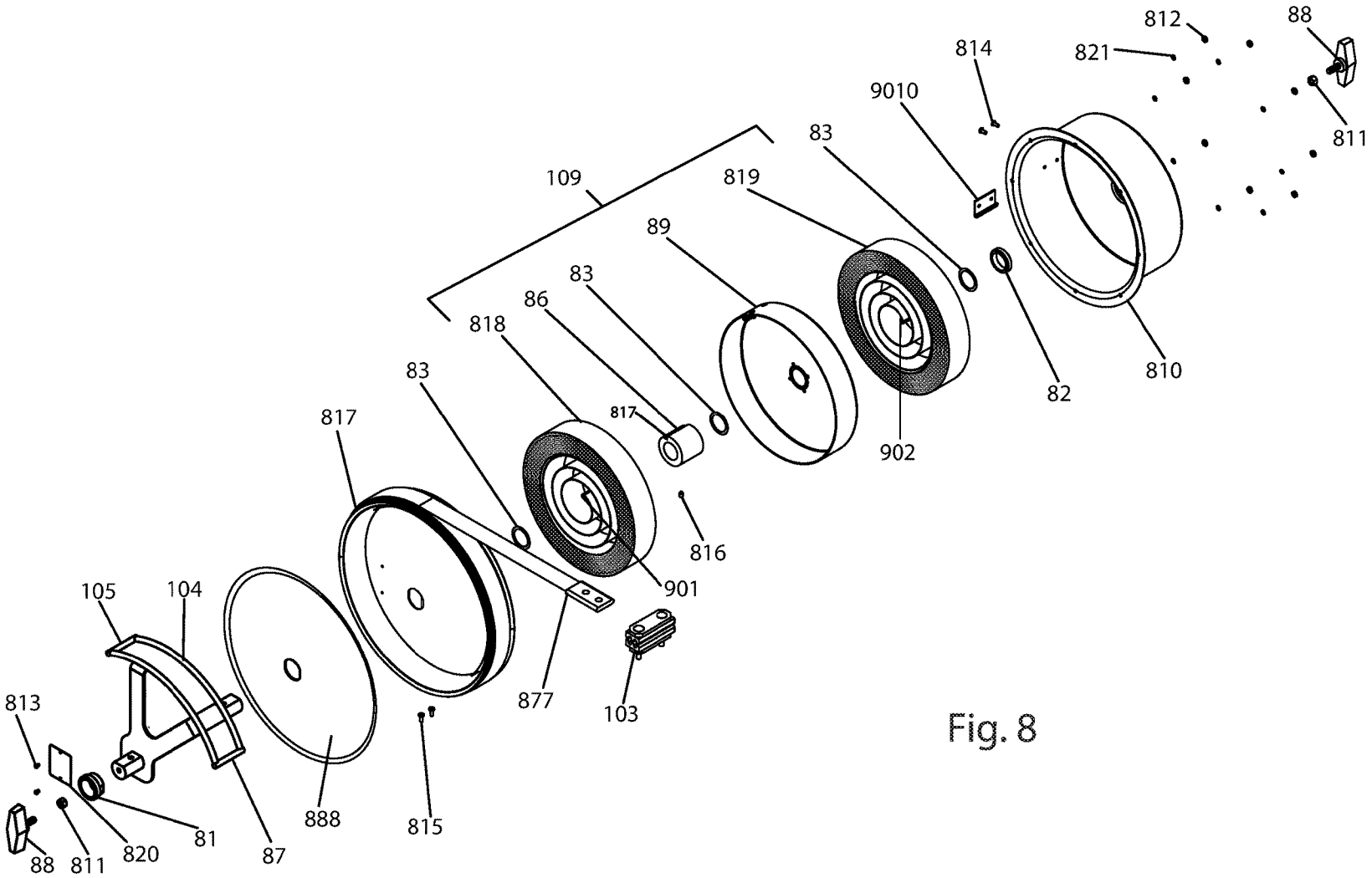
Figure 9:
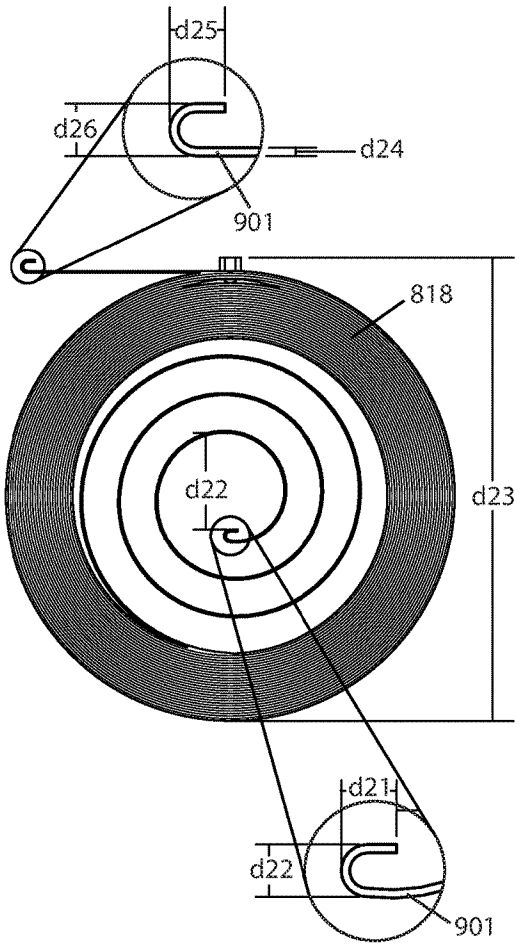

Referring next to FIGS. 8, 9 the reel 106 is a custom design to provide two springs 818, 819 tied in series via a collar 86. Collar 86 is anchored to the axle 202 with screw 816. The spring catch 817 receives the end hook 901 of one spring 818. The inner hook of 902 of the other spring 819 connects to a protrusion on the back side of item 89, so that the springs operate in series (end to end) as opposed to operating in parallel. Each spring is two inches wide, preferably with 18 total turns and a flat length of 520 inches.

A bushing 81 is held on the axle 202 by mount 110 in FIG. 3. Spool cover 888 spins as it is connected to the housing 810. Spring hook 9010 secures the outside end hook A of spring 818. Spring housing 89 spins. Bearing 82 spins around axle 202. The reel 888 in FIG. 8 spins around the axle (202). Basically, everything except the wire guide (878, 104, 105) rotates about the axle (202).

Nominal dimensions follow below:

d1=1.94"
d2=0.12"
d3=3.50"
d4=1.62"
d5=80'±6"
d6=1.50"
d7=0.75"
d8=1.00"
d9=0.50"
d10=0.25"
d11=2×0.23"
d12=3.00"
d13=1.25"
d14=2×0.44"
d15=0.93"
d16=1.86"
d17=0.63"
d18=0.38"
d19=0.35"
d20=0.12"
Cable 101 weave=1056/30
Ground Strap 102A and B weave=768/30

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

Installation Guidelines

The present invention is known commercially as the RGA 750™. It is designed to create the lowest impedance connection between the roof and shell of a floating roof tank by creating the shortest possible path between the two. This connection is obtained by keeping constant tension on the wide aluminum braided cable.

The following manual outlines the procedures required for proper installation of an RGA.

In many cases, the RGA is sold in conjunction with LEC's Dissipation Array System (DAS)™. A LEC site supervisor may be helpful for the DAS installation. The Supervisor could assist the on-site contactor that will be responsible for installing the DAS. This assistance includes training the contractor in the nuances of the installation and thereby ensuring proper installation.

Note: Review all documents and drawings prior to commencing work. The RGA can be installed on a tank during maintenance shut downs or while the tank is in service. Follow all plant safety procedures and acquire necessary permits.

Equipment and Tools Required

Pneumatic Punch, Hand Punch or Drill to create 7/16" [11 mm] diameter holes
9/16" or Adjustable Wrench×2
Wire Wheel or Brush
Lectra Shield
Note: Tap set or welder may be required if tank had bolted foam dam Supplied Parts

| Part Name | Quantity |
|---|---|
| Reel, 316L Stainless Steel | 1 |
| RGA Mount, 316L Stainless Steel | 1 |

-continued

| Part Name | Quantity |
|---|---|
| ⅜" 316 Stainless Steel Bolt | 2 |
| ⅜" 316 Stainless Steel Flat Washer | 2 |
| 1,056/30 Braided Aluminum Cable | 80 ft [24.4 m] |
| Cable Stop | 1 |
| Handle | 2 |
| Horizontal Bracket, Galvanized Steel | 1 |
| 12" Flexible Aluminum Ground Strap | 2 |
| ⅜" 316 Stainless Steel Bolt | 10 |
| ⅜" 316 Stainless Steel Nut | 10 |
| ⅜" 316 Stainless Steel Flat Washer | 20 |
| ⅜" Stainless Steel Lock Washer | 10 |
| Installation Manual | 1 |

Preparing Materials

Inspect reel, cable, hardware, grounding straps, mount and wire guide. Do not remove the shrink-wrap from cable on the reel at this time. Contact your LEC representative or LEC Sales Manager and DO NOT INSTALL the RGA if any of the parts are missing or damaged.

Layout and Tank Preparation

If an installation drawing with the RGA quantity and location is provided by LEC, mark the location(s) of where the RGA should be placed in accordance with the print. If a drawing is not provided, the RGAs should be equally spaced from each other according to API Recommended Practice 545, Recommended Practice of Lightning Protection of Aboveground Storage Tanks for Flammable or Combustible liquids, latest edition, which requires that bypass conductors be evenly spaced not more than every 100 ft. [30 m] around the circumference of the tank with a minimum of two. For example, 4 RGAs (bypass conductors) would be required for on 100 ft. [30 m] diameter tank. Each RGA would be placed 90° apart or roughly 78 ft-6½ in. [23.94 m] on the circumference of the rim of the tank. Mark these locations. Ideally, the RGA will be placed on the highest possible location of the tank: the fire suppression/swash plate, because explosive gases must not be present immediately around the reel during regular use. If the RGA cannot be mounted on the fire suppression plate or directly to the tank wall, use the Horizontal Bracket.

Note: Ensure that the RGA will not interfere with the tank roof when fully filled. Finally, if any obstacles or interference are encountered, contact the LEC Sales Manager for assistance.

Attaching the RGA to the Tank

The RGA can be mounted directly to the fire suppression plate/tank wall or the tank lip using the supplied Horizontal Bracket.

Mounting the RGA directly to the Tank Wall—Created four (4) 7/19 in. [11 mm] diameter holes in the tank wall. Scrape paint and rust from around the drilled holes and under the RGA Mount to bare metal. Apply Lectra Shield to both sides of the holes and all bare metal surfaces to prevent rusting. Using the supplied hardware, secure the RGA Mount and Reel assembly to the tank wall and apply Lectra Shield to the hardware after assembly. Alternately, the RGA Reel may first be separated from the Mount by removing the ⅜" bolts on either side of the Reel and the Mount may be attached to the tank wall separately from the Reel.

Mounting the RGA using the Horizontal Bracket—Two (2) 7/16" [11 mm] diameter holes need to be made in the field on the tank lip using the Horizontal Bracket as a template. Scrape paint and rust from around the drilled holes and under the Horizontal Bracket to bare metal. Apply Lectra Shield to both sides of the hole and all bare metal to prevent rusting. Using the supplied hardware, secure the Horizontal Bracket to the tank rim angle and apply Lectra Shield to the hardware after assembly. Attach the RGA Mount and Reel assembly to the Horizontal Bracket.

Grounding and Bending

Foam Dam Types—Two methods are commonly used to attach foam dams to floating roofs. It generally consists of an approximately ¼ in. [6.4 mm] thick piece of steel, approximately 18-24 in. [457-610 mm] tall, that is rolled to the approximate diameter of the tank and welded directly to the floating roof. A typical bolted foam dam connection generally consists of a series of 18-24 in. [457-610 mm] wide plates which are bolted to a welded portion of the floating roof. These foam dam plates are typically mounted over the primary and secondary seal fabric, as well as any gasket material, thereby resulting in unacceptably high impedance between the foam dam and floating roof.

RGA straps MAY NOT be attached to a bolted foam dam as seal fabric and gasket material prevent the establishment of an acceptable electrical connection between the straps and tank roof. If the tank has a bolted foam dam, additional mounting hardware will be required and the bolted foam dam strap installation procedure below must be followed.

Regardless of foam dam type, the attachment point on the floating roof must align vertically with the center of the braided cable wire. To facilitate vertical alignment, the RGA should be installed when the tank is at its fullest capacity. A 'plumb bob' or laser level can be used for best possible results (caution—a 'plumb bob' should only be utilized when the wind is calm). Maintaining vertical cable alignment within +/−12 in. [305 mm] will minimize cable wear and maximize cable life.

Locate a level portion of roof that is vertically aligned with the RGA and sufficiently inboard from the tank wall so that the RGA cable and straps will not rub against any portion of the bolted foam dam as the tank roof rises and falls. The RGA cable and straps will be nearest to the lip of the foam dam when the tank is at its fullest and the roof is near the top of the tank.

Scrape paint and rust on the roof to bare metal where the custom roof mount bracket will be placed. Weld the bracket all the way around to the tank roof. If welding is not possible, the bracket may be temporarily attached to the roof by drilling and tapping two (2) ⅜ in. holes, using the bracket as template. If the bracket is bolted to the roof, it should be welded in place during the next maintenance shutdown or when feasible to do so.

Apply Lectra Shield to the welded or bolted connection to prevent rusting.

Placing the RGA into Service

When the tank is ready to be placed into service, follow the steps below to finalize the installation:

1. Turn the RGA reel back and forth to verify that the reel rotates freely and does not bind.
2. Un-reel the RGA cable to the roof of the tank.
3. Pull the cable out the intended travel distance and carefully allow it to rewind. This procedure should be repeated five (5) to ten (10) times in order to prepare the springs for use.
4. Secure the supplied Ground Straps to the tank and RGA Cable, with the supplied stainless steel hardware.

5. Confirm cable retraction by pulling the cable out and letting it retract back.
6. Verify that all nuts and bolts are mechanically tight with clean electrical contact.

Note: Do not remove or adjust the position of the cable stop which is factory set 12" [305 mm] from the end of the cable to prevent loss of pre-tension turns.

Finally, coat all mechanical ground connections with Lectra Shield.

To maximize cable and strap service life, LEC recommends disconnecting the ground straps from the foam dam or custom bracket and allowing the cable to retract if the tank will be out of service for an extended period of time. The RGA Ground Straps should be reconnected before the rank is placed back into service. When reconnecting the Ground Straps remove any rust at the connection point to bare metal and apply Lectra Shield before and after securing the straps.

Welding the Horizontal Bracket

The Horizontal Bracket should be welded onto the tank lip during a maintenance shut down or when feasible to do so.

Corrosion Protection

For the RGA to function properly LEC requires a coating of Lectra Shield, a corrosion inhibitor, to be applied to all mechanical grounding connections as described above. Lectra Shield can be purchased directly from LEC.

LEC Shield LEC Part #0000120

LEC Approved Alternatives (if Lectra shield is unavailable):

Emerson & Cummings: ECCOCOAT CC 40 A

Sanchem Inc.: NO-OC-IC Special

Uninstall

In the event that the RGA must be removed from the tank, the following steps should be followed. The tank should be at its fullest capacity to minimize stored energy in the springs. Unbolt the ground strap from the foam dam or custom bracket without allowing the spring motor to recoil. Next, carefully retract the strap to the reel. Secure the strap to the reel with shrink-wrap or heavy-duty tape. While supporting the Reel, either unbolt and separate the Reel from the Mount, or unbolt and separate the Reel and Mount assembly from the tank. The RGA horizontal bracket, if the present, may then be unbolted from the tank.

Maintenance

RGAs are often installed in corrosive environments. The more corrosive the environment, the more frequently inspection and maintenance must be performed. At minimum, the following should be performed on an annual basis. LEC recommends an increase in the frequency of inspection/maintenance as conditions require.

Remove build-up from RGA cable and reel.

Keep the bearing well lubricated using Thomas & Betts Aluma-Shield PN M-53 or AP8, Sanchem Inc. NO-OX-ID "A-Special" or other electrically conductive lubricant.

Visually inspect the RGA cable for dirt, corrosion or tearing; if there is a tear in the cable, call your LEC Sales Manager immediately.

Ensure that all Ground Strap, Mount and Horizontal Bracket nuts and bolts are mechanically tight. Tighten any loose hardware immediately.

Replacement Parts

12" Flexible Aluminum Ground Strap

LEC Part #0010874

12" Flexible Aluminum Ground Straps (×2) and ⅜" SS Hardware

LEC Part #0010861

80 ft 1,056/30 Braided Aluminum Cable

LEC Part #0010863

ATEX Certification

The CE/Ex markings on the RGA signify the RGA's compliance with the requirements of Directive 94/9EC involving potentially explosive atmospheres. The various markings are described below.

CE CE Mark

Ex Specific mark for explosion protection

II Equipment Group II: intended for use above Ground, not for use in mines

2 Equipment Category 2: the equipment is protected against ignition hazards in normal operation where a gas is likely to occur under normal conditions G Equipment is intended for exposure to Explosive gasses and mists only (not Protected against explosive dusts)

T4 In normal operation, the maximum surface Temperature of the equipment will not exceed 275 deg. F. (135 deg. C.).

I claim:

1. In a fluid/liquid storage tank with a sidewall and a floating roof floating atop the fluid/liquid, an improved grounding system comprising:

a reel connected to the sidewall;

said reel having a low impedance conductor for lightning related frequencies connected to the floating roof;

said conductor comprising a bare braided aluminum cable;

said reel having a take up spool which keeps any slack out of the conductor and maintains a shortest fractional length;

said spool having a rewind spring assembly that produces about 80 to about 90 pounds of rewind tension at a maximum payout;

said reel having a cable guide with a built in cable stop anchor and a low resistance connection to a spool axle;

wherein an excess length of said conductor is wound around said take up spool thereby shorting together adjacent sections of said conductor wound around said take up spool;

said conductor having a cable stop; and said reel having a U shaped mounting bracket that bolts to a flat indent on a left end of the spool axle and to a flat indent on a right end of the spool axle.

2. The grounding system of claim 1, wherein the spring assembly further comprises two springs tied in series via a collar.

3. The grounding system of claim 1, wherein the U shaped mounting bracket further comprised a flat flange at each of its ends which fit against the respective flat indent.

4. The grounding system of claim 1, wherein the cable guide has a welded connection to the spool axle.

5. The grounding system of claim 1, wherein the bare braided aluminum cable is about 1⅜" wide by about 0.120" thick.

6. The grounding system of claim 5, wherein the bare braided aluminum cable has a double braided connection assembly for bolting to a vertical roof flange between a first and a second braid of the double braided connection assembly.

7. The grounding system of claim 1, wherein the bare braided aluminum cable with the cable stop is pre-tensioned at final assembly with the cable stop tensioned against the cable stop anchor.

8. The grounding system of claim 1, wherein the maximum payout is about 80 feet.

9. The grounding system of claim 1, wherein the spool axle further comprises a handle at each end.

10. The apparatus of claim 1 further comprising a plurality of said reels and low impedance conductors connected to the sidewall.

11. In a fluid/liquid storage tank with a sidewall and a floating roof floating atop the fluid/liquid, an improved grounding system comprising:

a reel connected to the sidewall;

said reel having a low impedance conductor for lightning related frequencies connected to the floating roof;

said conductor comprising a bare braided aluminum cable;

said reel having a take up spool which keeps any slack out of the conductor and maintains a shortest fractional length;

said spool having a rewind spring assembly that produces about 80 to about 90 pounds of rewind tension at a maximum payout;

said reel having a cable guide with a built in cable stop anchor and a low resistance connection to a stationary spool axle;

wherein an excess length of said conductor is wound around said take up spool thereby shorting together adjacent sections of said conductor wound around said take up spool;

said conductor having a cable stop; and said reel having a U shaped mounting bracket that connects to the stationary spool axle.

12. The grounding system of claim 11, wherein the spring assembly further comprises two springs tied in series via a collar.

13. The grounding system of claim 11, wherein the U shaped mounting bracket further comprised a flat flange at each of its ends which fit against a respective flat indent on each end of the stationary spool axle.

14. The grounding system of claim 11, wherein the cable guide has a welded connection to the spool axle.

15. The grounding system of claim 11, wherein the bare braided aluminum cable is about 1⅜" wide by about 0.120" thick.

16. The grounding system of claim 15, wherein the bare braided aluminum cable has a double braided connection assembly for bolting to a vertical roof flange between a first and a second braid of the double braided connection assembly.

17. The grounding system of claim 11, wherein the bare braided aluminum cable with the cable stop is pre-tensioned at final assembly with the cable stop tensioned against the cable stop anchor.

18. The grounding system of claim 11, wherein the maximum payout is about 80 feet.

19. The grounding system of claim 11, wherein the spool axle further comprises a handle at each end.

20. The apparatus of claim 11 further comprising a plurality of said reels and low impedance conductors connected to the sidewall.

* * * * *